US005117209A

United States Patent [19]

Sato

[11] Patent Number: 5,117,209

[45] Date of Patent: May 26, 1992

[54] ELECTROMAGNETIC RELAY

[75] Inventor: Ryuichi Sato, Kyoto, Japan

[73] Assignee: Omron Corporation, Kyoto, Japan

[21] Appl. No.: 637,033

[22] Filed: Jan. 3, 1991

[30] Foreign Application Priority Data

Jan. 12, 1990 [JP] Japan ..... 2-6006
Mar. 28, 1990 [JP] Japan ..... 2-79564

[51] Int. Cl.[5] ..... H01H 51/22
[52] U.S. Cl. ..... 335/80; 335/78
[58] Field of Search ..... 335/78-86, 335/124, 128

[56] References Cited

U.S. PATENT DOCUMENTS

| | | | |
|---|---|---|---|
| 4,199,740 | 4/1980 | Woods | 335/128 |
| 4,328,476 | 5/1982 | Bernier | 335/128 |
| 4,355,291 | 10/1982 | Agatahama | 335/128 |
| 4,602,230 | 7/1986 | Schedele | 335/79 |
| 4,912,438 | 3/1990 | Yokoo | 335/78 |

*Primary Examiner*—Leo P. Picard
*Assistant Examiner*—Lincoln Donovan
*Attorney, Agent, or Firm*—Fish & Richardson

[57] ABSTRACT

In the electromagnetic relay of the present invention, a fixed contact and a movable contact piece are separated from an electromagnetic block and a movable iron piece, so that an insulating distance is elongated, with improving the resistance to voltage. The electromagnetic relay can be compact in size while ensuring highly resistive property to voltage.

3 Claims, 7 Drawing Sheets

ELECTROMAGNETIC RELAY

BACKGROUND OF THE INVENTION

1. Field of the Invention

The present invention generally relates to an electromagnetic relay and, more particularly to an electromagnetic relay having high resistance to voltage.

2. Description of the Prior Art

In a conventional electromagnetic relay such as illustrated in FIGS. 10 and 11, an electromagnetic block 1 formed by winding a coil 1*b* around an iron core 1*a* is erected on the upper surface of a base 3 via a generally L-shaped yoke 2. When an inverse L-shaped movable iron piece 4 supported at an upper end of the yoke 2 is rotated against the elasticity of a coil spring 5 in response to the excitation and demagnetization of the electromagnetic block 1, thereby driving a movable contact piece 6, a movable contact 6*a* at a free end of the movable contact piece 6 is alternately brought into or out of contact with fixed contacts 7*a* and 8*a* of fixed contact pieces 7 and 8.

Insulation is retained in the electromagnetic relay of the above-described type, however, in a simple manner by, e.g., enlarging the distance between the electromagnetic block 1 and movable contact piece 6, or between the electromagnetic block 1 and fixed contact pieces 7,8. As such, if the components are arranged closer to each other in order to form a compact relay, desired insulating property cannot be achieved. Therefore, it has conventionally been difficult to realize a compact electromagnetic relay.

SUMMARY OF THE INVENTION

An essential object of the present invention is to provide an electromagnetic relay having highly resistive property to voltage.

A further object of the present invention is to provide an electromagnetic relay enabling an apparatus to be compact in size while ensuring desired insulating property.

In accomplishing the above-described objects, according to the present invention, an electromagnetic relay is provided wherein a fixed contact terminal is formed through insertion-molding in a prop part projecting on an upper surface of a base, with a fixed contact being exposed from an upper end face of the prop part, so that a movable contact formed in a movable contact piece is brought into contact with or detached from the fixed contact when the movable contact piece is driven by a movable iron piece rotated in response to the magnetization and demagnetization of the electromagnetic block on the upper surface of the base. An insulating frame body is integrally formed with the movable iron piece, thereby separating the movable contact piece and fixed contact from the electromagnetic block and movable iron piece.

Since the fixed contact terminal is formed in the prop part through insertion-molding, an outer side surface of the fixed contact terminal is covered and the fixed contact alone is exposed. Besides, since the fixed contact and movable contact piece are separated from the electromagnetic block and movable iron piece by the insulating frame body, the spatial distance therebetween can be shortened in comparison with the prior art. Accordingly, even when the components are arranged close to each other, the insulating distance can be kept long, thereby achieving an electromagnetic relay compact in size and with desired insulating property.

Further, the electromagnetic relay according to the present invention is comprised of a base having a fixed contact exposed upwards from the vicinity of the peripheral portion of an upper surface thereof, an electromagnetic block positioned approximately at the center of the upper surface of the base and having a magnetic pole exposed approximately at the center of the upper surface thereof, a movable iron piece rotatably supported approximately at the center of a lower surface thereof by the magnetic pole of the electromagnetic block and a movable contact piece block integrally formed with an insulating bed having a movable contact piece insertion-molded at the center of the upper surface of the movable iron piece, so that the movable contact piece block as well as the movable iron piece rotated in response to the magnetization and demagnetization of the electromagnetic block is rotated thereby to open/close the contacts. The electromagnetic relay includes an insulating frame body integrally provided between the movable iron piece and movable contact piece block so that the movable contact piece and fixed contact are separated from the electromagnetic block and movable iron piece.

Accordingly, since the insulating frame body can separate the fixed contact and movable contact piece from the electromagnetic block and movable iron piece, the insulating distance can be long, improving the resistive property to voltage. The electromagnetic relay with high resistance to voltage is realized.

BRIEF DESCRIPTION OF THE DRAWINGS

These and other objects and features of the present invention will become apparent from the following description taken in conjunction with preferred embodiments thereof with reference to the accompanying drawings, in which:

FIG. 1 is an exploded perspective view of the relay;

FIG. 2 is a sectional plan view;

FIG. 3 is a cross sectional view taken along the line III—III of FIG. 2;

FIG. 4 is a front sectional view of an essential portion;

FIG. 5 is a side sectional view of an essential portion;

FIGS. 6–8 are views explanatory of the operation of a movable iron piece;

DESCRIPTION OF THE PREFERRED EMBODIMENTS

Figure 1:
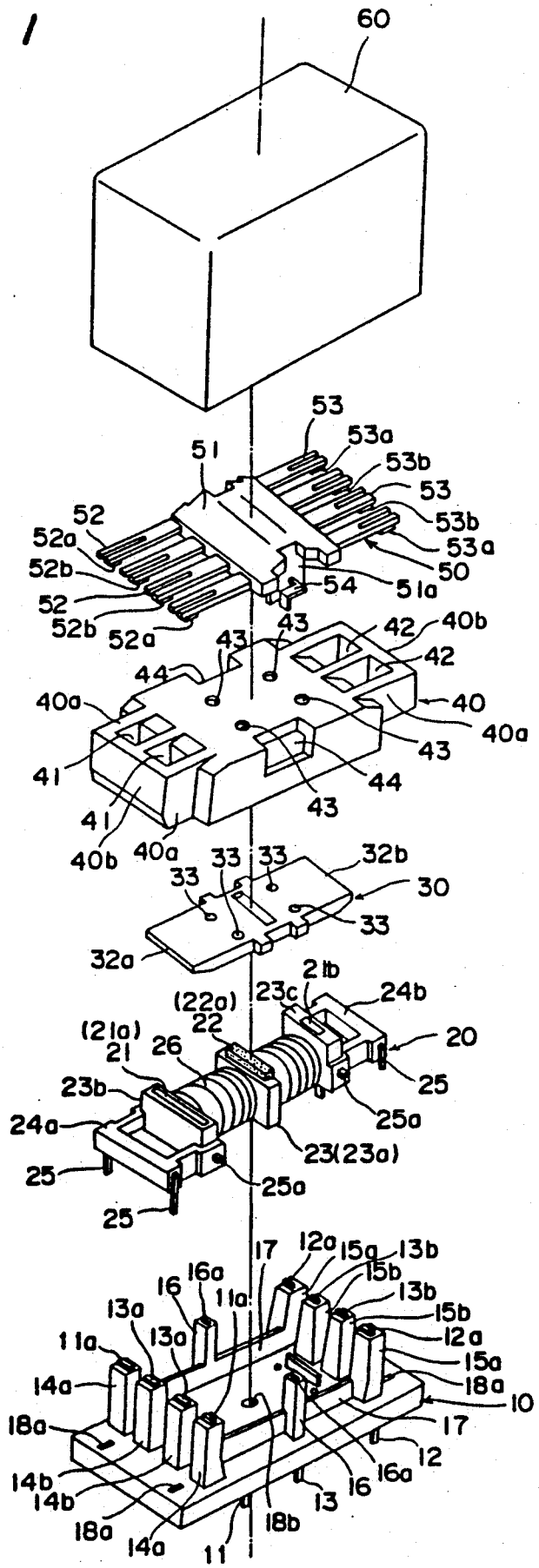
FIGS. 1–8 show an electromagnetic relay according to a first embodiment of the present invention.

An electromagnetic relay of the present invention will be described hereinbelow with reference to FIGS. 1–9.

An electromagnetic relay according to a first embodiment is generally comprised of a base 10, an electromagnetic block 20, a movable iron piece 30, an insulating frame body 40, a movable contact piece block 50 and a casing 60.

The base 10 having a generally rectangular plan is provided with fixed contact terminals 11, 12 and common contact terminals 13 through insertion-molding, each in pairs in symmetry (contact terminals 11–13 at the deep side are not shown in FIG. 1). Prop parts 14*a*,14*b*,14*b*,14*a* and 15*a*,15*b*,15*b*,15*a* are erected in the vicinity of the periphery of shorter sides of the base 10, and positioning prop parts 16,16 are formed at the intermediate position between the prop parts 14*a* and 15*a*.

An upper end of the fixed contact terminal 11 is electrically connected to a fixed contact 11*a* formed at an upper surface of the prop part 14*a* via a lead frame (not shown). Likewise, an upper end of the fixed contact terminal 12 is electrically connected to a fixed contact 12*a* at an upper surface of the prop part 15*a* via a lead frame (not shown). Meantime, an upper end of the common contact terminal is divided into two, one being electrically connected to a fixed contact 13*a* formed at an upper surface of the prop part 14*b* via a lead frame (not shown) and the other being electrically connected to a fixed contact 13*b* formed at an upper surface of the prop 15*b* via a lead frame (not shown). There is an insertion hole 16*a* formed at an upper surface of each prop part 16. An insulating wall 17 extends between the prop part 16 and the prop parts 14*a*,15*a*. References 18*a*,18*b* represent a coil terminal hole and a vent hole, respectively.

An iron core 21 originally having a generally U-shaped cross section is turned into an E-shaped cross section after a permanent magnet 22 is arranged therein. The iron core 21 with the permanent magnet 22 is then insertion-molded with a spool 23, thereby eventually composing the electromagnetic block 20. A magnetic pole 22*a* of the permanent magnet is exposed from an upper surface of a central jaw 23*a* of the spool 23. A left magnetic pole 21*a* of the iron core is exposed from an upper surface of a jaw 23*b* of the spool 23, while a right magnetic pole 21*b* of the iron core 21 is exposed from an upper surface of a jaw 23*c* of the spool 23. Frame parts 24*a*,24*b* are integrally molded at the outer side faces of the jaws 23*b*,23*c*, respectively, to which are insertion-molded coil terminals 25,25. A leading wire of a coil 26 wound around the spool 23 is tied and soldered to a tie-up portion 25*a* of each coil terminal 25, as shown in FIG. 1.

Although the iron core 21 is made of a plate having a predetermined thickness, since the left magnetic pole 21*a* is formed wider than the right magnetic pole 21*b*, the magnetic force is not balanced between the left and right portions because of the large attracting area of the right pole 21*a*. In FIG. 1, the right coil terminal 25 is shorter than the left coil terminal 25, so that the right coil terminal is not projected from the rear surface of the base 10 when inserted into the coil terminal hole 18*a*.

When the electromagnetic block 20 is positioned above the base 10 and temporarily fixed by pressing the coil terminals 25 into the coil terminal holes 18*a*, the prop parts 14*b*,14*b* and 15*b*,15*b* are projected from the frame parts 24*a* and 24*b*, respectively.

The movable iron piece 30 with a generally rectangular plan has a protruding part 31 formed at the central part of a lower surface thereof through ejection treatment A lower surface of each end 32*a*,32*b* is tapered. Moreover, four caulking holes 33 are formed in the movable iron piece 30 at such a position that the protruding part 31 is found intermediate between the two confronting holes 33.

The insulating frame body 40 is a box shape capable of concealing the movable iron piece 30. The prop parts 14*b*,15*b* of the aforementioned base 10 are loosely fitted in respective fitting holes 41,42 formed at end portions of the insulating frame body 40. Each caulking hole 43 of the frame body 40 confronts to the caulking hole 33 of the movable iron piece 30. Moreover, the insulating frame body 40 has notched stepped portions 44,44 formed at the central part of the side faces.

Figure 4:
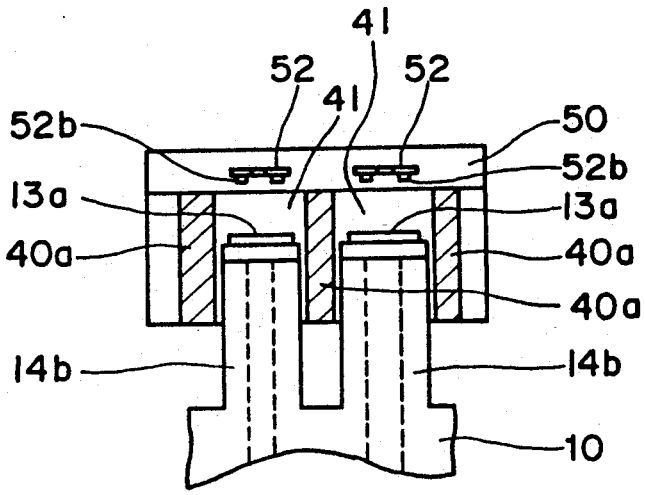

According to this embodiment, as shown in FIG. 4, the fixed contacts 11*a*,13*a* and 12*a*,15*a* are separated from each other by partition elements 40*a* in a combed arrangement defining the fitting holes 41(42). Therefore, high insulating property is secured.

Front ends of the partition elements 40*a* are integrally coupled by a coupling part 40*b*, so that the partition elements 40*a* are hard to deform. However, the coupling part 40*b* is provided so as only to achieve desired insulating property, and is not necessarily required.

Figure 5:
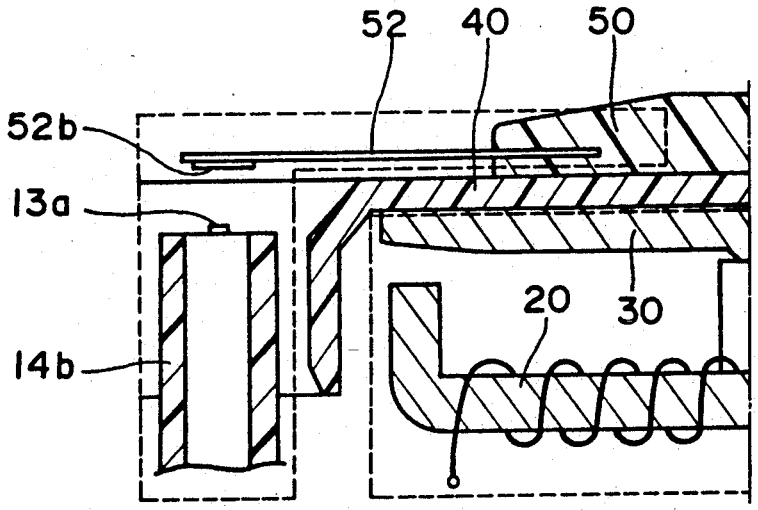
Figure 6:
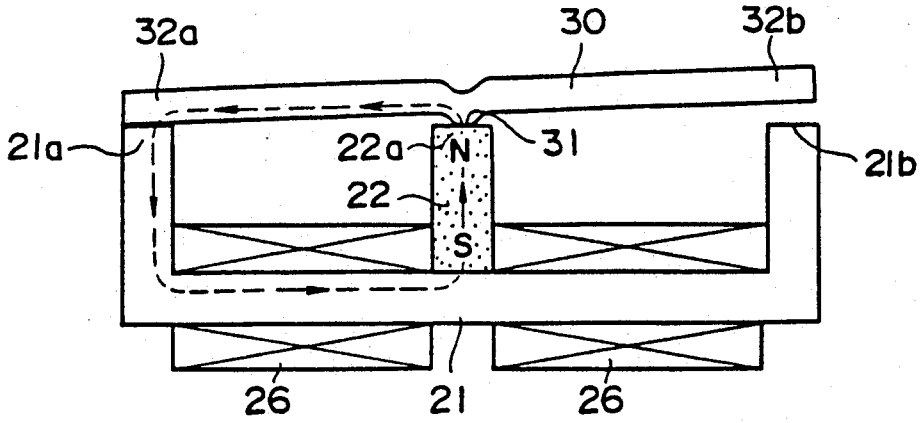

Furthermore, since the insulating frame body 40 separates the electromagnetic block 20 and movable iron piece 30 from a movable contact piece 52 and the fixed contact 13*a* as shown in FIG. 5, a long insulating distance is gained, which results in good insulating property of the relay.

Figure 2:
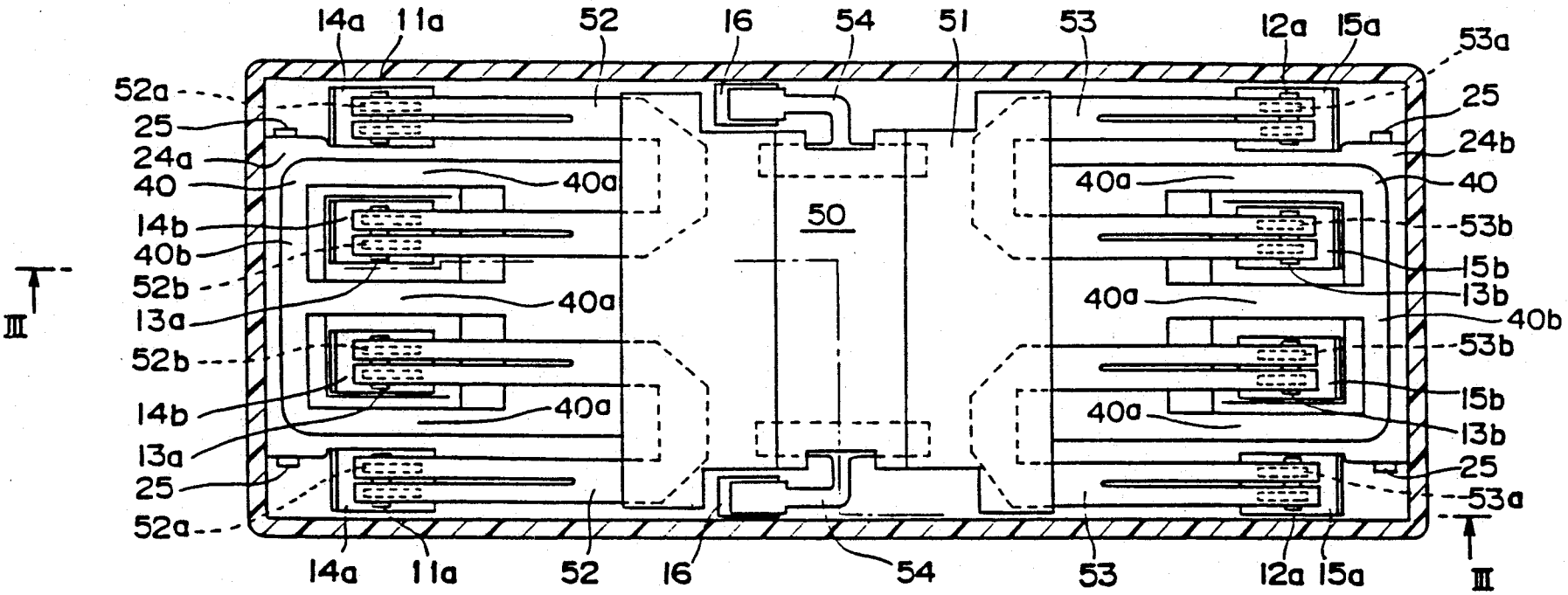
Figure 3:
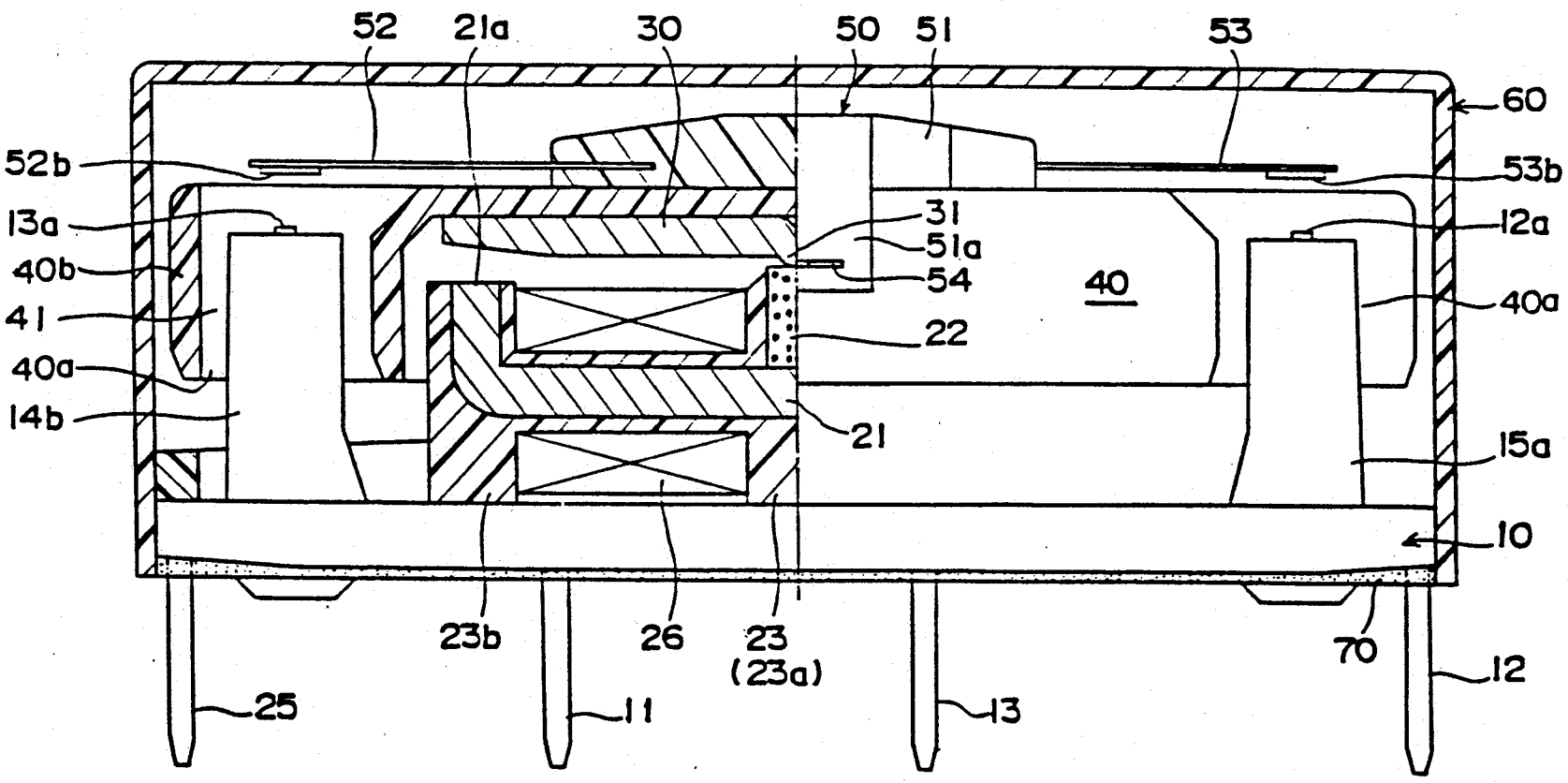

The movable contact piece block 50 is obtained by insertion-molding two movable contact pieces 52 and two movable contact pieces 53, each having a generally U-shaped plan, in front of and behind an insulating bed 51 (referring to FIG. 2). At the central part of a lower surface of the insulating bed 51 is projected a caulking protrusion (not shown) to be inserted into the caulking hole 43 of the insulating frame body 40 and caulking hole 33 of the movable iron piece 30. A tongue piece 51*a* (one at the deep side is not shown) is projected downwards from each side edge of the lower surface of the insulating bed 51. Meanwhile, a hinge spring 54 of a generally L-shaped plan is projected sideways from each outer side face of the tongue piece 51*a*. A free end of this hinge spring 54 is bent downwards in a vertical direction.

Both end portions of the U-shaped movable contact piece 52 is divided into two in a widthwise direction. A movable contact 52*a* and a movable contact 52*b* are formed at the lower surface of the one of the divided ends and at the lower surface of the other of the divided ends, respectively. Similar to the movable contact piece 52, the movable contact piece 53 also has movable contacts 53*a*,53*b* formed at the lower surface of the end portions.

The tongue piece 51*a* of the insulating bed 51 is fitted in the notched stepped portion 44 of the insulating frame body 40, and at the same time, the caulking protrusion (not shown) of the insulating bed 51 is inserted into the caulking holes 43 and 33. Then, the protruding ends are thermally caulked As a result, the movable iron piece 30, insulating frame body 40 and movable contact piece block 50 are integrally formed into one unit.

Subsequently, the obtained unit is positioned above the base 10 and fixed by pressing the ends of the hinge springs 54 into respective insertion holes 16*a* of the prop parts 16. The protruding part 31 of the movable iron piece 30 is brought to butt against the magnetic pole 22*a* of the permanent magnet 22, so that the movable iron piece 30 is supported in a rotatable manner, with the movable contacts 52*a*,52*b* and 53*a*,53*b* rendered so confronting to the fixed contacts 11*a*,13*a* and 12*a*,13*b* as to be in and out of contact with each other.

In the state where the unit is totally assembled (FIG. 3) in the manner as above, the surface of the magnetic pole of the permanent magnet 22, protruding part 31 of the movable iron piece 30 and hinge springs 54 are found approximately on the same plane, whereby an excessive bending moment is not applied to the relay, thus ensuring smooth operation, etc.

Since the movable contacts 52*a*,52*b* and 53*a*,53*b* are projected further than the ends 32*a* and 32*b* of the movable iron piece 30 in the present embodiment, the rotating radius of the movable contact pieces 52,53 becomes long. Therefore, even if the movable iron piece 30 is rotated a little quantity of angles, it is possible to open/-close the contacts. Accordingly, the electromagnetic relay features a large gap of contacts with high sensitivity and less consumption of power.

The casing 60 is generally in the form of a box able to be fitted with the base 10. After a sealing agent 70 is injected and hardened into a recess formed when the casing 60 is fitted with the base 10, the gas inside is let out from the vent hole 18*b* of the base 10. Thereafter, the vent hole 18*b* is thermally melted to seal the casing. Thus, the electromagnetic relay is completely assembled.

The operation of the electromagnetic relay in the above-described structure will be discussed below.

In the case without excitation, the left end 32*a* of the movable iron piece 30 is attracted to the left magnetic pole 21*a* of the iron core 21 due to the magnetic flux of the permanent magnet 22 (indicated by a broken line in FIG. 6), thereby closing the magnetic circuit. Accordingly, the movable contacts 52*a*,52*b* of the movable contact piece 52 are brought in touch with the fixed contacts 11*a*,13*a*, whereas the movable contacts 53*a*,53*b* are separated from the fixed contacts 12*a*,13*b*.

Figure 7:
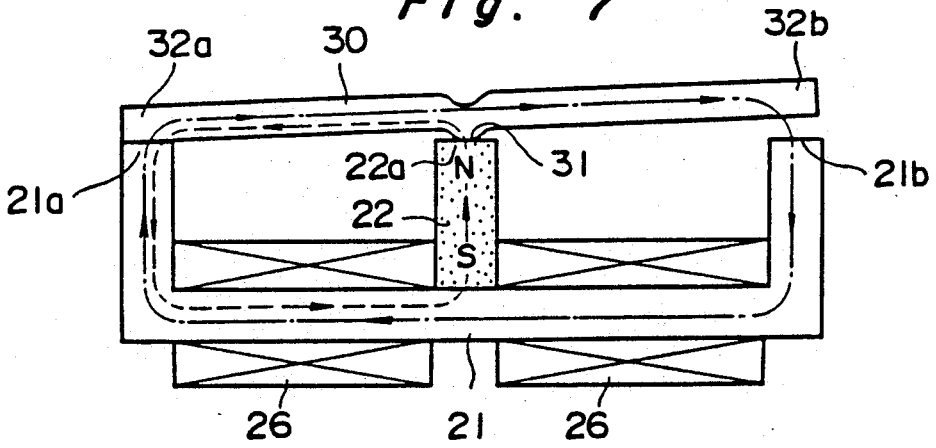
Figure 8:
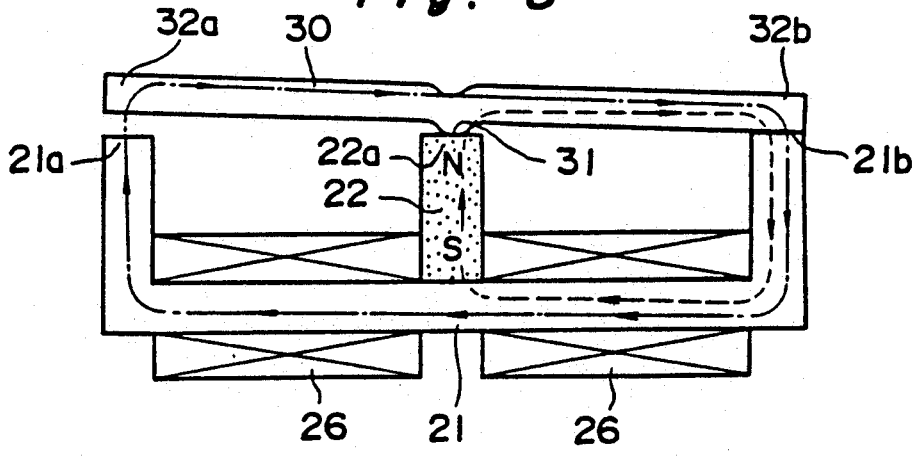

When the coil 26 is magnetized through application of such a voltage that a magnetic flux negating the above magnetic flux is generated (indicated by a one-dot chain line) as shown in FIG. 7, the right end 32*b* of the movable iron piece 30 is attracted to the right magnetic pole 21*b* of the iron core 21. As a result, the movable iron piece 30 is rotated around the protruding part 31 as a fulcrum against the magnetic force of he permanent magnet 22, thereby detaching the left end 32*a* of the movable iron piece 30 from the left magnetic pole 21*a*. The right end 32*b* of the movable iron piece 30 is attracted to the right magnetic pole 21*b* (FIG. 8). Accordingly, the movable contacts 52*a*,52*b* of the movable contact piece 52 are separated from the fixed contacts 11*a*,13*a*, and then, the movable contacts 53*a*,53*b* are brought into touch with the fixed contacts 12*a*,13*b*.

If the coil 26 is demagnetized, because of the spring force of the movable contact pieces 53,53 and hinge springs 54 and due to the fact that the left magnetic pole 21*a* of the iron core 21 has the larger attracting area than the right magnetic pole 21*b*, the movable iron piece 30 is returned to its original position. The movable contacts 52*a*,52*b* and 53*a*,53*b* are changed over. The electromagnetic relay is returned to the original state.

According to the first embodiment, the movable contact pieces 52,53 are formed in a generally U-shaped plan, that is, a so-called double-break configuration. Therefore, the distance between the fixed contact 52*b* and movable contact 11*a* can be reduced half in comparison with the case where the movable contact pieces 52,53 are formed in a so-called single-break configuration. Accordingly, the electromagnetic relay can be small in height, making it possible to form an apparatus compact in size.

Figure 9:
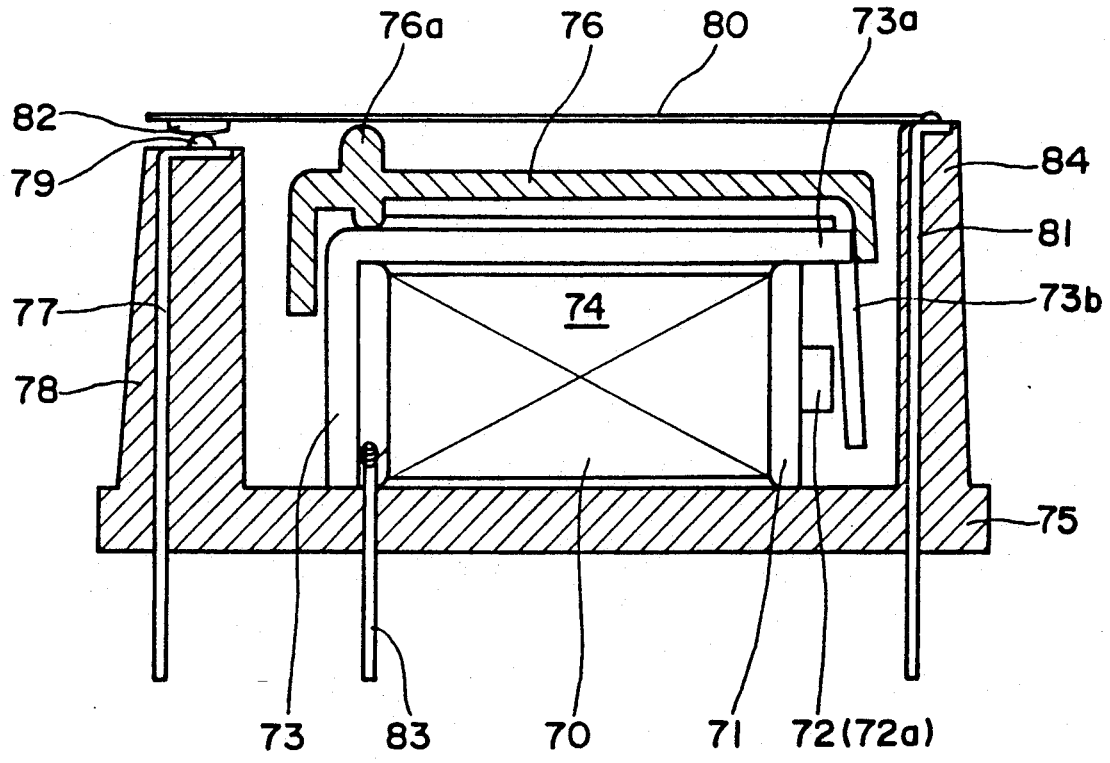
FIG. 9 is a side sectional view of an electromagnetic relay according to a second embodiment of the present invention.
Figure 10:
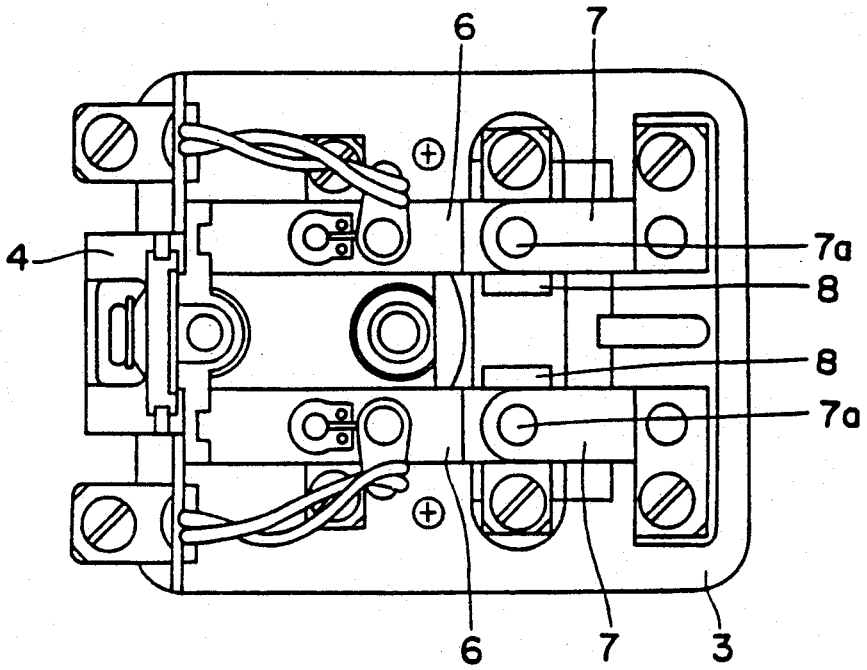
Fig. 10 PRIOR ART
FIGS. 10 and 11 are a plan and a side elevational views of a conventional electromagnetic relay.
Figure 11:
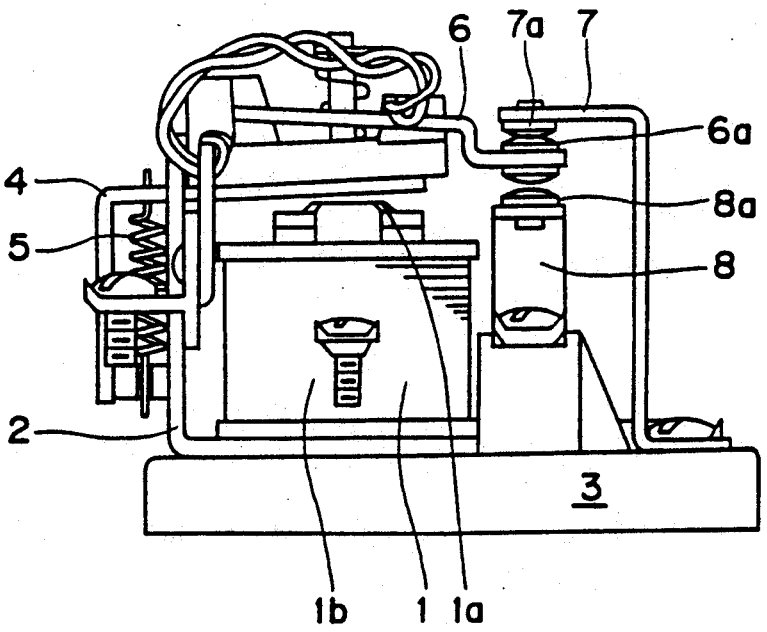
Fig. 11 PRIOR ART

With reference to FIG. 9, in a second embodiment of the present invention, fixed contacts are formed at one side of the electromagnetic block although they are formed at both sides of the block in the above-described first embodiment.

More specifically, an iron core 72 is inserted into a spool 71 having a coil 70 wound therearound. One projecting end of the iron core is made a magnetic pole 72*a*, and the other end is securely caulked to a perpendicular portion of a generally L-shaped yoke 73. An electromagnetic block 74 constituted in the above-described manner is placed at the central part of an upper surface of a base 75. A generally inverse L-shaped movable iron piece 73*b* is supported by a horizontal end portion 73*a* of the yoke 73. An insulating frame body 76 is integrally formed on an upper insertion-molded at one side edge of an upper surface of the base 75. A fixed contact 79 is exposed from an upper surface of the prop part 78. On the other hand, a prop part 84 has a movable contact terminal 81 insertion-molded at the other side edge of the upper surface of the base 75, which is erected on the base 75. The movable contact terminal 81 is welded with a movable contact piece 80 at an upper end thereof. A movable contact (82) formed at a free end of the movable contact piece 80 confronts to the fixed contact 79 in a detachable manner. A reference 83 is a coil terminal.

In the case without excitation, the movable contact (82) is in touch with the fixed contact 79 by the spring force of the movable contact piece 80.

When the electromagnetic block 74 is magnetized through application of a voltage to the coil 70, an end of the perpendicular portion of the movable iron piece 73*b* is attracted to the magnetic pole 72*a* of the iron core 72. The movable iron piece 73*b* is rotated against the spring force of the movable contact piece 80, and a protrusion 76*a* of the insulating frame body 76 pushes up the movable contact piece 80. As a result, the movable contact (82) is separated from the fixed contact 79.

Then, when the electromagnetic block 74 is demagnetized, the movable contact piece 80 is returned to the original position by its own spring force, thereby bringing the movable contact (82) into touch with the fixed contact 79.

Although the electromagnetic relay in the foregoing description of the first and second embodiments of the present invention is a self-returning type, a self-retaining type may be possible by adjusting the shape of the iron core or the spring force of the movable contact piece, etc.

Although the present invention has been fully described by way of example with reference to the accompanying drawings, various changes and modifications would be apparent to those skilled in the art. Therefore, such changes and modifications should be construed as included therein unless they depart from the scope of the present invention.

What is claimed is:

1. An electromagnetic relay which comprises:

a base having a fixed contact terminal insertion-molded in a prop part erected on an upper surface thereof;

a fixed contact exposed from an upper face of said prop part;

an electromagnetic block provided on the upper surface of said base;

a movable iron piece rotated subsequent to the magnetization or demagnetization of said electromagnetic block; and a movable contact piece driven by said movable iron piece, so arranged that a movable contact formed in said movable contact piece is brought into or out of touch with said fixed contact, wherein an insulating frame body forming an enclosure with downwardly projecting walls is integrally provided with said movable iron piece, thereby to separate said movable contact piece and fixed contact from said electromagnetic block and movable iron piece, said insulating frame body fixedly enclosing said electromagnetic block and said movable iron piece.

2. An electromagnetic relay which comprises:

a fixed contact exposed upwards from the vicinity of an edge of an upper surface of a base;

an electromagnetic block positioned at generally the central part of the upper surface of said base and having a magnetic pole exposed at the central part of the upper surface thereof;

a movable iron piece rotatably supported at generally the central part of the lower surface thereof by said magnetic pole of the electromagnetic block; and a movable contact piece block integrally formed with an insulating bed having a movable contact piece insertion-molded at the central part of the upper surface of said movable iron piece, so arranged that said movable contact piece block is rotated along with said movable iron piece which is rotated subsequent to the magnetization or demagnetization of said electromagnetic block, thereby to open/close the contacts, wherein an insulating frame body forming an enclosure with downwardly projecting walls is integrally provided between said movable iron piece and movable contact piece block so that said movable contact piece and fixed contact are separated from said electromagnetic block and movable iron piece, said insulating frame body fixedly enclosing said electromagnetic block and said movable iron piece.

3. An electromagnetic relay according to claim 1 or claim 2, wherein a partition element is formed integrally with said insulating frame body at lateral ends of said insulating frame body, said partition element provided with vertical holes through which said fixed contact piece extends, and separating adjacent said fixed contact pieces.

* * * * *